US006439099B1

(12) United States Patent
Carlson et al.

(10) Patent No.: US 6,439,099 B1
(45) Date of Patent: Aug. 27, 2002

(54) EXPLOSIVE CHARGES BRAIDED INTO A LINE CHARGE ASSEMBLY

(75) Inventors: Victor J. Carlson, Ellicot City; Ferrell Windsor Furr, Laurel; Robert Grande, Owings Mills; John R. Luense, Accokeek, all of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/662,165

(22) Filed: Sep. 14, 2000

(51) Int. Cl.[7] ..... F41H 11/12

(52) U.S. Cl. ..... 89/35.01; 89/1.13; 206/3; 102/275.12

(58) Field of Search ..... 89/35.01, 34, 1.13; 206/3; 102/275.12

(56) References Cited

U.S. PATENT DOCUMENTS

| | | | | | |
|---|---|---|---|---|---|
| 722,123 | A | * | 3/1903 | Mills | 89/35.01 |
| 3,908,549 | A | | 9/1975 | Turner | 102/27 R |
| 3,968,725 | A | | 7/1976 | Holzhauer | 87/6 |
| 4,083,305 | A | | 4/1978 | Garrison et al. | 102/27 R |
| 4,230,041 | A | | 10/1980 | Bailey et al. | 102/27 R |
| 4,292,896 | A | | 10/1981 | Morrey et al. | 102/275.8 |
| 4,312,272 | A | | 1/1982 | Baker et al. | 102/275.8 |
| 4,438,699 | A | | 3/1984 | Nitzberg | 102/312 |
| 4,643,097 | A | | 2/1987 | Chawla et al. | 102/306 |
| 4,643,119 | A | | 2/1987 | Langston et al. | 112/421 |
| 4,693,167 | A | * | 9/1987 | Bagwell, Jr. | 206/443 |
| 4,714,018 | A | | 12/1987 | Lofgren | 102/275.7 |
| 5,524,524 | A | | 6/1996 | Richards et al. | 89/1.13 |
| 5,540,154 | A | | 7/1996 | Wilcox et al. | 102/275.1 |
| 5,675,104 | A | | 10/1997 | Schorr et al. | 89/1.13 |
| 6,182,573 | B1 | * | 2/2001 | Richards et al. | 102/275.12 |

* cited by examiner

*Primary Examiner*—Stephen M. Johnson
(74) *Attorney, Agent, or Firm*—Mark Homer

(57) ABSTRACT

A line explosive charge attaching system connects individual explosive charges in line with a yarn structure having yarns interlocked in a braided structure to cover and position several individual explosive charges together.

15 Claims, 2 Drawing Sheets

EXPLOSIVE CHARGES BRAIDED INTO A LINE CHARGE ASSEMBLY

STATEMENT REGARDING FEDERALLY SPONSORED RESEARCH OR DEVELOPMENT

The invention described herein may be manufactured arid used by or for the government of the United States of America for governmental purposes without the payment of any royalties thereon or therefor.

BACKGROUND OF THE INVENTION

1. Field of the Invention

The present invention includes an explosive line charge. More particularly, high tenacity textile yarns are braided over individual explosive line charges to fix the position of the explosive charges in relation to each other with the covering of tubular braided material.

2. Brief Description of the Related Art

Connecting explosive charges in relation to each other is useful in explosive systems. This allows controlled sequenced explosions, when desired. Methods of connecting a number of explosive charges together are seen in current land mine clearing, shallow water mine clearing, and anti-personnel mine clearing explosive systems.

For connecting the explosive charges in the land mine clearing system, a nylon rope is sandwiched between blocks of explosive which are have been placed in a double pocket plastic bag and then skrapped with adhesive tape to hold them in place on the rope. The charges are then explosively connected to each other with two pieces of detonating cord which have been previously assembled onto the rope. The detonating cord transfers the detonation wave from one explosive charge to the next. This subassembly, of charges, rope, and detonating cord is slid into two lengths of hollow, woven tubular, nylon fabric sleeves. The explosive charges are held in place inside the fabric sleeves by tying short pieces of line around the outside of the fabric sleeves at the end of each charge. This, in theory, prevents the explosive charges from moving inside the fabric sleeves upon rocket launch, deceleration, or ground impact. The land mine clearing line charge method of connecting the charges has several limitations. Upon rocket launch, the charges slide around inside the fabric sleeves even though they are supposed to be held in place by the lines tied around the outside of the fabric sleeves. It is extremely difficult to tie the lines tight enough to prevent this motion. As a result, the charges end up in the back end of the fabric sleeves. This results in an uneven distribution of the explosive charges. In addition, on some occasions the acceleration forces are such that upon rocket launch some of the charges are expelled through the side of the fabric sleeves. Another disadvantage of this method of attachment is that there is a limited length of charges which can be inserted into the fabric sleeves.

In the shallow water mine clearing system, the explosive is housed in a thin metal container which is sandwiched between two aluminum flanges joined together with six bolt like pins. Each charge is connected to the next charge with two nylon webbings which are attached to the pins. The charges are connected explosively with a long piece of detonating cord that is inserted through the middle of the charges. The shallow water mine clearing method of attachment has severe limitations in that a great deal of weight must be added to the explosive charges to carry the rocket launch loads and acceleration. The weight of the flanges pins and webbing is a significant percentage of the overall weight and limits how far the rocket can launch the charges from the launch craft. In addition the metal parts such as the flange and the pins, which in the case of the shallow water mine clearing system weigh 504 pounds, pose a significant fragmentation hazard to the launch craft upon detonation. Finally, the cost of these parts represents a significant portion of the system cost.

The anti-personnel mine clearing method of connecting the explosive charges is to attach them to two nylon ropes by means of two metal band clamps which by means of friction, hold the charges to the ropes. The charges are explosively connected with a single piece of detonating cord that is inserted through the middle of the charges. The anti-personnel mine clearing method of connecting the explosive charges poses a hazard of the exposed hose clamps snagging during the deployment by the rocket motor. This method of assembly is also time consuming and prone to human error in the process of assembling the ropes to the charges.

The existing line charge systems, such as the land mine clearing, shallow water mine clearing, and anti-personnel mine clearing systems, connect the explosive charges together with either metal parts and ropes, webbing, or woven fabric sleeves. These methods of connecting the explosive charges makes the system expensive, heavy, and time consuming to assemble. Also the presence of metal components creates a fragmentation hazard to launch craft and personnel when the explosive line charge detonates.

There is a need in the art to provide a system for joining a number of explosive charges together into a line with a simple strong attachment system. The present invention addresses this and other needs.

SUMMARY OF THE INVENTION

The present invention includes a line explosive charge attaching system for connecting individual explosive charges in line comprising a yarn structure having a plurality of yarns interlocked in a braided structure capable of covering and positioning a plurality of individual explosive charges therein.

The present invention also includes a line explosive charge device comprising a plurality of individual explosive charges and a line explosive charge attaching system having a yarn structure braided over the plurality of individual explosive charges, the yarn structure having a plurality of yarns interlocked in a braided structure sufficient to position the plurality of individual explosive charges therein, wherein frictional forces between the plurality of individual explosive charges and yarn structure fix the position of the plurality of individual explosive charges in relation to each other.

Additionally the present invention includes a method for attaching a braiding structure to a plurality of individual explosive charges comprising the steps of positioning the explosive charges in the center of a braiding machine, initiating interweaving of yarn over the individual explosive charges with the braiding machine and calibrating the rate of interweaving with the feed rate of additional individual explosive charges to form a braid angle along the length between the individual explosive charges, wherein the plurality of yarns interlock into a braided structure sufficient to position the plurality of individual explosive charges in line therein.

DETAILED DESCRIPTION OF THE PREFERRED EMBODIMENT

The present invention includes an explosive charge system having tubular braided covering to fix individual explosive charges in relation to each other, generally in a line charge. The present invention joins a selected number of explosive charges together, into a line, with a reliably strong attachment mechanism. The explosive charges are frictionally held in place between the braided yarn and the explosive charge, which may be further fixed in position with adhesively bonding the braid to the explosive charge. The braiding process results in a light weight flexible structure which can be designed to meet the particular structural, weight, and elongation needs for using the explosive line charge system.

Figure 1:
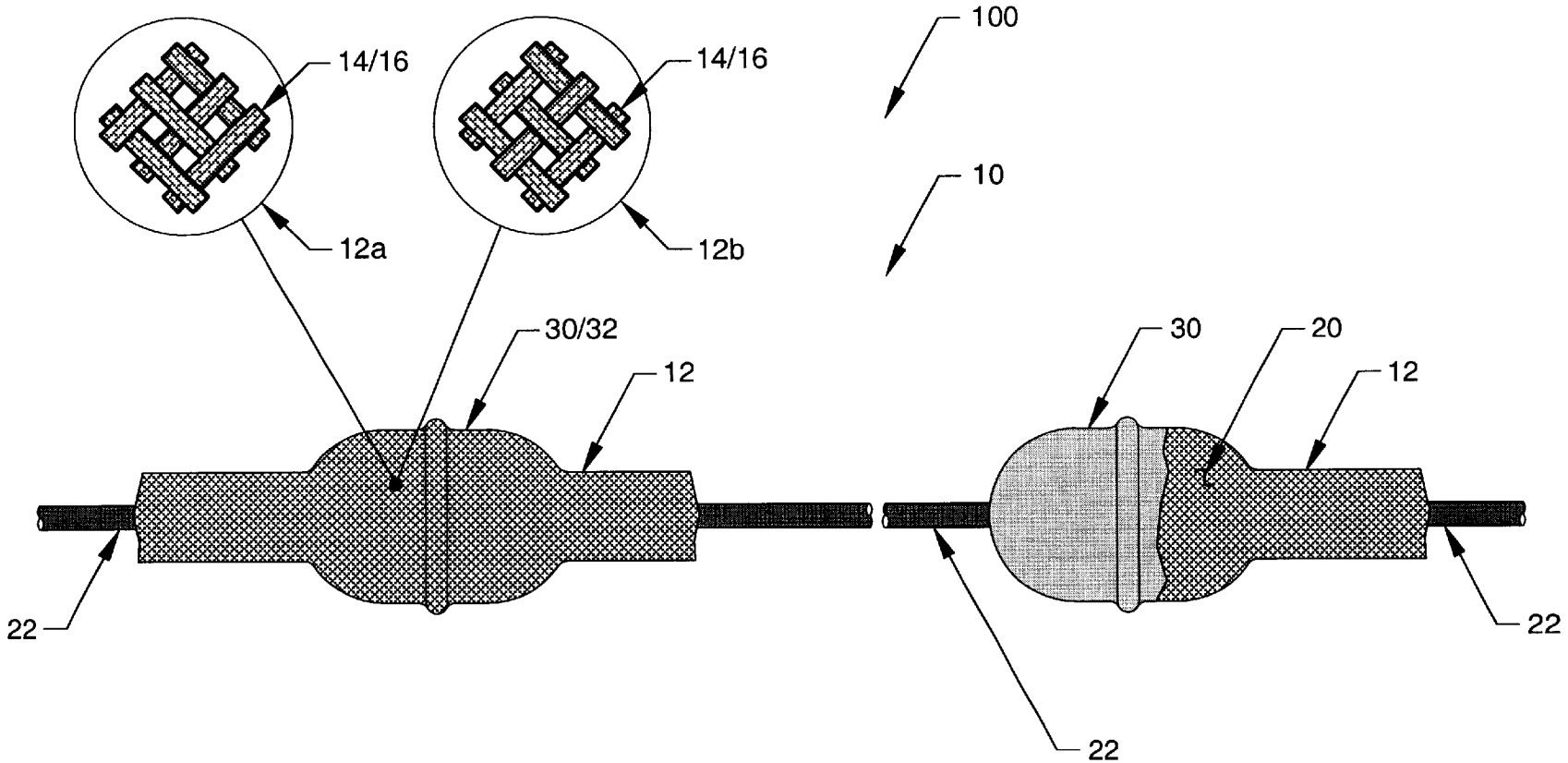
FIG. 1 illustrates the overbraided explosive line charge of the present invention; and, FIG. 2 illustrates a method of overbraiding explosives into a line charges, as shown in FIG. 1.

As seen in FIG. 1, the present invention includes a line explosive charge attaching system 10 for connecting individual explosive charges 30 into a line charge or line explosive charge device 100. The line explosive attaching system 10 connects the individual explosive charges 30 with a yarn structure 12 having a plurality of yarns 14 that are interlocked in a braided structure. The yarn structure 12 is braided in a manner that covers and positions the individual explosive charges 30 relative to each other. This positioning of a plurality of individual explosive charges 32 with the yarn structure 12 permits the individual explosive charges 30 to interact with one another during detonation.

The yarns 14 may be any suitable material for combining, the individual explosive charges 30 into the line charge 100 as determinable by those skilled in the art in light of the disclosure herein. As used herein, the term "yarn" includes, twisted or untwisted, single and/or bundles of fibers, threads, tows filaments, and/or other elongated structures that are commonly known or understood to be bound or combined together in a braided pattern. Yarns 14 are selected for their physical thermal and chemical properties of yarn denier, tenacity, elongation, modulus of elasticity, shrinkage, density moisture absorption, smoothness, and other like characteristics that are appropriate for a given environment in which the yarns 14 are to be used. Both natural fibers and man made fibers may be used. Suitable yarns 14 may include, without limitations materials such as nylon, polyester, aramid, and/or combination of these and other materials. Preferably, the yarn structure 12 comprises a single material.

The yarns 14 of the line explosive charge attaching system 10 comprise an appropriate yarn denier 16 and elongation for overbraiding and use. Preferably the yarn denier 16 of the present invention ranges from about 840 grams/9000 meters to about 22,880 grams/9000 meters, with a range of from about 1200 grams/9000 meters to about 20,000 grams/9000 meters being more preferred. Suitable elongation coefficients of the yarn 14 preferably ranges from about 2 percent to about 50 percent, with a more preferred range of from about 15 percent to about 30 percent.

With the positioning and retention of the plurality of individual explosive charges 32 within the line explosive charge attaching system 10, the individual explosive charges 30 cooperatively act together to maximize the function of the line explosive charge device 100. Each individual explosive charge 30 within the line explosive charge device 100 remains attached to and fixed relative to other individual explosive charges 30 With the braided yam structure 12. Positioning of the individual explosive charges 30 within the line explosive charge attaching system 10 may allow for movement of the individual explosive charges 30 within the yarn structure 12, as determinable by those skilled in the art. Although preferably the individual explosive charges 30 have minimal movement within the yarn structure 12, such as lateral movement along the length of the yarn structure 12 of from about two inches or less, movement of the individual explosive charges 30 may extend up to approximately one-third of the length between the individual explosive charges 30 to allow positioning of the line explosive charge device 100, when desired. Lateral movement is determined by several factors that affect the interlocking or confinement of the individual explosive charge 30 with the yarns structure 12 and/or the frictional forces experienced by the individual explosive charges 30 with the yarns 14. These factors non-exclusively include the type of braid, type of yam, number of yarns 14, additional adhesives, texture of the yarn, texture of the individual explosive charges 30, and other like factors which may be determined and selected by those skilled in the art. Preferably the line explosive charge device 100 comprises a braided yarn structure 12 that interlocks the individual explosive charges 30 within the braid to sufficiently position the individual explosive charges 30 with a degree of 5% or less of the distance between the individual explosive charges 30. For example, when the distance between two individual explosive charges 30 equals 10 feet, each individual explosive charge 30 may move up to approximately ½ foot in either direction, or a total distance of one foot. Unlike other systems that fix the position of the individual explosive charges 30, the yarn structure 12 of the present invention allows selection of an amount, as well as minimization, of lateral movement for a given purpose while ensuring that the individual explosive charges remain confined within a fixed location of the line explosive charge device 100. Preferably, the braided yarn structure 12 substantially covers each individual explosive charges 30, with the individual explosive charges 30 more preferably being one hundred percent covered.

Although the diameter of the braided yarn structure 12 chances as it passes over the individual explosive charges 30, holding the chalices in place, an increased hold between the braid and the individual explosive charges 30 may be desired to prevent the explosive charges 30 from moving forward or backward (laterally) inside the braided yarn structure 12. Preferably, the line explosive charge device 100 further comprises a means for adhering 20 the plurality of individual explosive charges 32 within the braided yarn structure 12. The means for adhering 20 may include any appropriate adhesive or mechanical bonding for attaching the individual explosive charges 30 within the braided yarn structure 12. Suitable adhesives include film one part two part and other known compositions that bind two materials together, such as bonding film, polyurethane resin, epoxy, and other like compositions suitable for attaching the individual explosive charges 30 onto the yarns 14. Preferably, the mechanical means for adhering 20 comprises a shrink material such as heat shrink material and/or air heat shrink material to attach the yarns 14 to the plurality of individual explosive charges 32. Exemplary adhesive materials include a film composition sold under the tradename Scotch Roll 588, manufactured by 3M Company of St. Paul. Minn. a one part polyurethane resin composition sold under the tradename Estane 5715, manufactured by B. F. Goodrich Co. of Cleveland. Ohio; and a two part epoxy composition sold under the tradename Hysol 608, manufactured by Dexter Corporation of Seabrook. N.H. Exemplary shrink materials include an air shrink composition sold under the tradename Air Shrink/No Heat by Insulation Systems, Inc. of Santa Clara. Calif. and a heat shrink composition sold under the tradename Thermofit by Raychem Corporation of Menlo, Calif. Adhesives may be added at any time during the braiding process, such as before, during or after the braiding process.

Additionally, interconnections 22 may be used between the individual explosive charges 30 within the present invention. These interconnections 22 are preferably within the yarn structure 12 and extend between each of the individual explosive charges 30. In one preferred embodiment, the plurality of individual explosive charges 32 are connected together with with an interconnection 22 of detonating cord, such as detonating cord sold under the tradename DetCord manufactured by The Ensign-Bickford Company of Graham, Ky.

Figure 2:
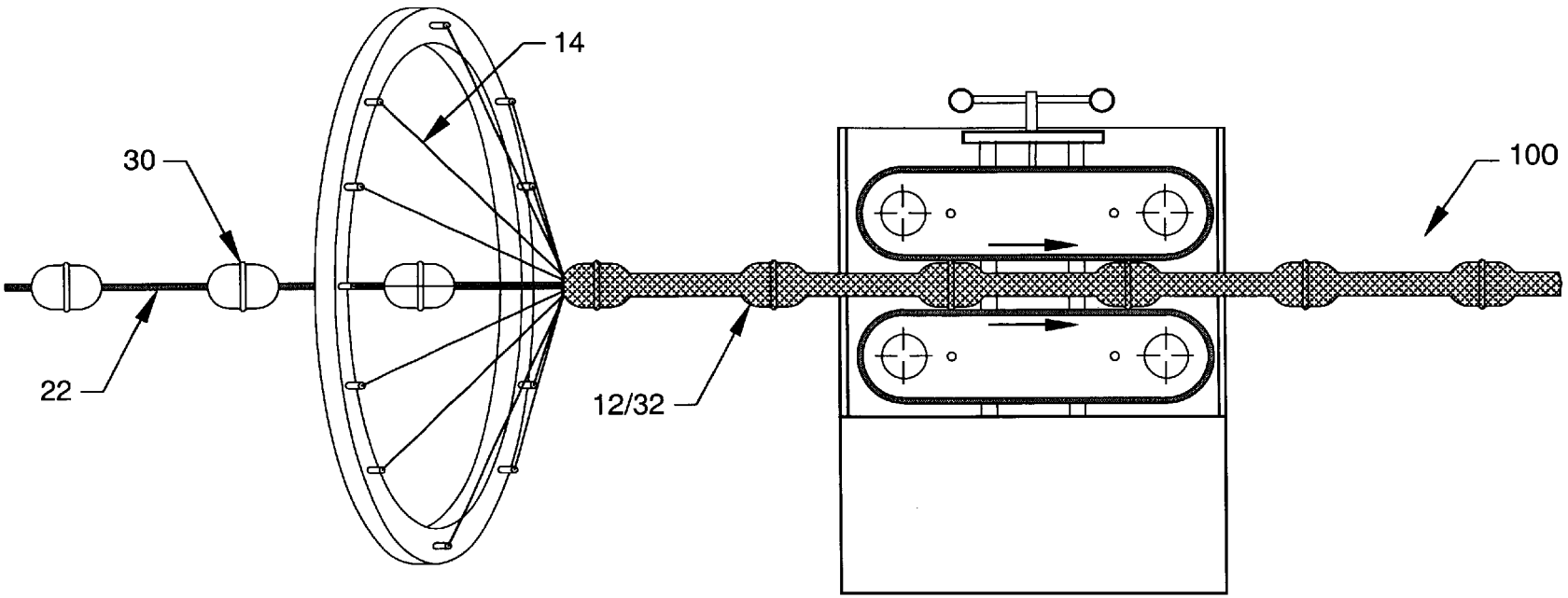

As seen in FIG. 2, the line explosive charge device 100 may be manufactured using a braiding machine in conjunction with a caterpillar take-off. The braided yarn structure 12 is attached to the plurality of individual explosive charges 32 by positioning the individual explosive charges 30 in the center of the braiding machine and initiating interweaving of the yarn 14 over the individual explosive charges 30 with the braiding machine. With detonation cord 22 passing through their center, the explosive charges 30 are held in the center of a maypole braiding machine, and the interweaving of the braid is started. As the braiding progresses, the explosive charges 30 are pulled through the center of the braiding machine at the correct feed rate. The rate of interweaving is calibrated with the feed rate of additional individual explosive charges 30 in a manner to form a selected braid angle along the length between the individual explosive charges 30. The rate of feed of the explosive charges 30 is varied so that the correct amount of braid is applied to the front and the back of the explosive charges 30. After an explosive charge 30 has been braided over, the machine braids over the detonation cord 22 to the next explosive charge 30, with the braiding process continued until the desired line explosive charge device 100 length has been reached. Braid patterns include any suitable pattern for fixing the individual explosive charges 30 within the yarn structure 12. Preferably the interweaving creates a braid pattern which is a regular braid (two over, two under), or a diamond braid (one over, one under), shown in FIG. 1 at 12*a* and 12*b* respectively. The interlocking of the plurality of yarns 14 provides a braided yarn structure 12 sufficient to position, the plurality of individual explosive charges 32 relative to each other with proper confinement and frictional forces, as determinable by those skilled in the art. Preferably, the braiding machine comprises a maypole braiding machine, such as the braiding machine sold by Wardwell Braiding N Machine Co. of Central Falls, Rhode Island, having a number of helical yarn carriers that can vary from 8 to 250, preferably having 144.

By connecting the explosive charges 30 with braided yarns 14, most metal parts may be eliminated from the line explosive charge device 100, reducing cost, weight, and fragmentation hazards of the line explosive charge attaching system 10. The reduced cost makes for a more cost effective weapon system, the reduced weight results in greater flight distances for a given rocket motor or more explosive can be used on a weight limited system. Fragmentation reduction results in a safer weapon system for the launching craft and launch personnel. The braided yarn structure 12 provides a light weight structure which with the over braiding of the individual explosive charges 30 together with the yarns 14, the present invention eliminates the need for metal parts, rope, webbing, and hose. The method of attachment of the present invention allows the line explosive charge attaching system 10 to be optimized for a particular launch load or acceleration by adjusting the material and denier of the braiding yarns, braiding angles, yarn elongation, and other parameters. Assembly of the line explosive charge attaching system 10 is more efficient than existing methods of assembly, requiring less manpower to complete the assembly.

EXAMPLES

A line charge of the present invention is manufactured to be used in oil well or military operations. The type and denier of the yarn is selected to provide particular characteristics to the final line charge. An individual explosive charge is placed at the centerline of a maypole braiding machine and fed into the weave pattern. Additional explosive charges are fed into the braiding machine at a given rate.

Example 1

For the procedure described above, the selected yarn is nylon having a denier of 1680. The individual explosive charge are fed into the braiding machine at a rate of 4.000 inches per minute with the maypole braiding, machine running at a rate of 120 picks per minute producing a regular braid pattern (a pick being one yarn crossover). The final line charge has an elongation coefficient of 38 percent, with each explosive charge separated from adjacent explosive charges by a distance of 16.375 inches. Each explosive charge is completely wrapped with yarn, with the explosive charges having a lateral movement within the line charge of approximately plus or minus ¼ inch.

Example 2

For the procedure described above, the selected yarn is polyester having a denier of 3360. The individual explosive charge are fed into the braiding machine at a rate of 12.375 inches per minute with the maypole braiding machine running at a rate of 180 picks per minute producing a regular braid pattern. The final line charge has an elongation coefficient of 44 percent, with each explosive charge separated from adjacent explosive charges by a distance of 16.375 inches. Each explosive charge is completely wrapped with yarn, with the explosive-charges having a lateral movement within the line charge of approximately plus or minus ¼ inch.

The foregoing summary, description, and examples of the present invention are not intended to be limiting, but are only exemplary of the inventive features which are defined in the claims.

What is claimed is:

1. A line explosive charge attaching system in combination with individual explosive charges in line comprising a tubular yarn structure having a plurality of yarns interlocked in a braided structure, and entirely covering and positioning a plurality of individual explosive charges therein.

2. The line explosive charge attaching system of claim 1, wherein the plurality of yarns comprise a material selected from the group consisting of nylon, polyester, aramid, and combination thereof.

3. The line explosive charge attaching system of claim 2, wherein the plurality of yarns comprise nylon.

4. The line explosive charge attaching system of claim 2, wherein the plurality of yarns comprise polyester.

5. The line explosive charge attaching system of claim 2, wherein the plurality of yarns comprise aramid.

6. The line explosive charge attaching system of claim 1, wherein the plurality of yarns comprise at least two different materials.

7. The line explosive charge attaching system of claim 1, comprising a yarn denier of from about 840 grams per 9000 meters to about 29,880 grams per 9000 meters.

8. The line explosive charge attaching system of claim 1, comprising an elongation coefficient of from about 2 percent to about 50 percent.

9. The line explosive charge attaching system of claim 8, comprising an elongation coefficient of from about 15 percent to about 30 percents.

10. The line explosive charge attaching system of claim 1, wherein the plurality of individual explosive charges are connected to each other.

11. The line explosive charge attaching system of claim 10, wherein the plurality of individual explosive charges are connected with detonating cord.

12. The line explosive charge attaching system of claim 1, wherein frictional forces between the plurality of individual explosive charges and the tubular yarn structure fix the position of the plurality of explosive charges in relation to each other.

13. The line explosive charge attaching system of claim 12, further comprising means for adhering the plurality of individual explosive charges within the tubular yarn structure.

14. The line explosive charge attaching system of claim 13, wherein the means for adhering comprises an adhesive to attach the tubular yarn structure to the plurality of individual explosive charges.

15. The line explosive charge attaching system of claim 13, wherein the means for adhering comprises heat shrink material to attach the tubular yarn structure to the plurality of individual explosive charges.

* * * * *